US006438873B1

(12) United States Patent
Gebhard et al.

(10) Patent No.: US 6,438,873 B1
(45) **Date of Patent: *Aug. 27, 2002**

(54) SHOE HAVING AN EXTERNAL CHASSIS

(75) Inventors: Jeff Gebhard, Portland; Charles D. Kraeuter, Lake Oswego, both of OR (US)

(73) Assignee: adidas International B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/633,398

(22) Filed: Aug. 7, 2000

Related U.S. Application Data

(63) Continuation of application No. 09/112,633, filed on Jul. 9, 1998, now Pat. No. 6,119,373, which is a continuation-in-part of application No. 08/697,184, filed on Aug. 20, 1996, now Pat. No. 5,915,820

(60) Provisional application No. 60/052,053, filed on Jul. 9, 1997.

(51) Int. Cl.[7] ..... A43B 5/00; A43B 7/14; A43B 13/14; A61F 5/14

(52) U.S. Cl. ..... 36/114; 36/31; 36/154; 36/155; 36/166; 36/103

(58) Field of Search ..... 36/28, 32 R, 30 R, 36/31, 154, 155, 102, 145, 166, 71, 87, 103, 114, 11, 88, 91, 92, 107, 15, 161

(56) References Cited

U.S. PATENT DOCUMENTS

| | | | | | |
|---|---|---|---|---|---|
| 43,469 | A | | 7/1864 | Bacon | |
| 730,366 | A | | 6/1903 | Gunthorpe | |
| 2,353,829 | A | | 7/1944 | Jakosky | |
| 2,680,919 | A | | 6/1954 | Riggs | |
| 3,204,347 | A | | 9/1965 | Snow | |
| 3,550,597 | A | | 12/1970 | Coplans | |
| 4,255,877 | A | * | 3/1981 | Bowerman | 36/71 |
| 4,309,831 | A | * | 1/1982 | Pritt | 36/32 R |
| 4,398,357 | A | | 8/1983 | Batra | |
| 4,439,934 | A | | 4/1984 | Brown | |
| 4,449,307 | A | | 5/1984 | Stubblefield | |
| 4,542,598 | A | | 9/1985 | Misevich et al. | |
| 4,543,651 | A | | 9/1985 | Misevich et al. | |
| 4,546,556 | A | | 10/1985 | Stubblefield | |
| 4,547,979 | A | | 10/1985 | Harada et al. | |
| 4,550,510 | A | | 11/1985 | Stubblefield | |
| 4,559,724 | A | | 12/1985 | Norton | |
| 4,562,651 | A | | 1/1986 | Frederick et al. | |
| 4,715,131 | A | | 12/1987 | Kremendahl | |
| 4,783,910 | A | | 11/1988 | Boys, II | |
| 4,803,747 | A | | 2/1989 | Brown | |
| 4,989,349 | A | | 2/1991 | Ellis, III | |
| 5,131,173 | A | | 7/1992 | Anderié | |
| 5,317,819 | A | | 6/1994 | Ellis, III | |
| 5,319,866 | A | | 6/1994 | Foley et al. | |
| 5,384,973 | A | | 1/1995 | Lyden | |
| 5,400,528 | A | | 3/1995 | Skinner et al. | |
| 5,408,761 | A | | 4/1995 | Gazzano | |
| 5,469,642 | A | * | 11/1995 | Farbman | 36/103 |
| 5,794,359 | A | * | 8/1998 | Jenkins et al. | 36/28 |
| 5,915,820 | A | * | 6/1999 | Kraeuter et al. | 36/114 |
| 5,918,385 | A | * | 7/1999 | Sessa | 36/28 |
| 6,119,373 | A | * | 9/2000 | Gebhard et al. | 36/114 |
| 6,148,544 | A | * | 11/2000 | Keen et al. | 36/114 |

FOREIGN PATENT DOCUMENTS

| | | |
|---|---|---|
| WO | 91/12740 | 9/1991 |
| WO | 92/11777 | 7/1992 |
| WO | 94/13164 | 6/1994 |

* cited by examiner

*Primary Examiner*—Anthony Stashick
(74) *Attorney, Agent, or Firm*—Testa, Hurwitz & Thibeault, LLP

(57) ABSTRACT

An athletic shoe including a upper, a support member or "chassis" attached to the underside of the upper, and sole elements attached to the bottom of the support member. The support member provides support for the foot, and thereby permits use of spaced apart sole elements rather than a full midsole and a full outsole. In addition, the support member can be tailored to provide the optimum stiffness for a particular activity or user.

25 Claims, 6 Drawing Sheets

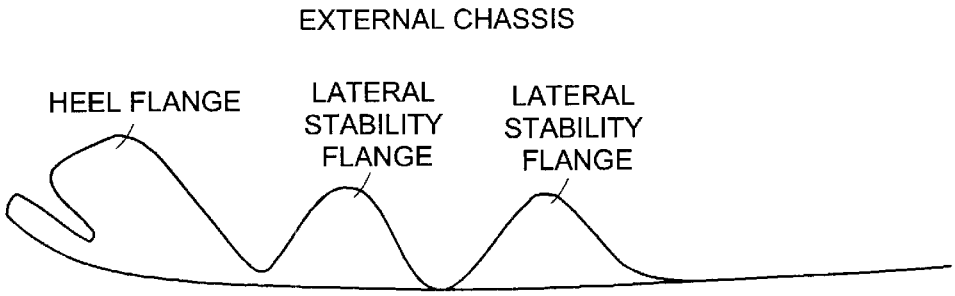
FIG. 6 PROFILE VIEW
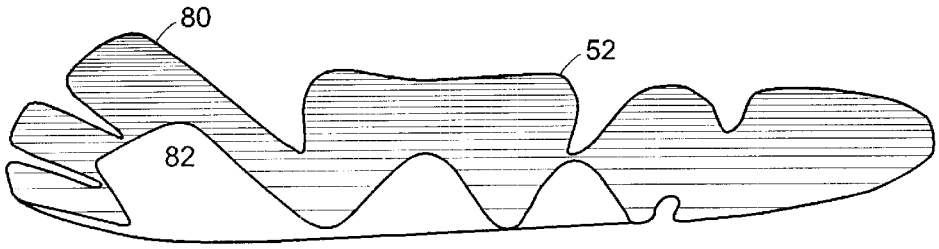
FIG. 7 PERSPECTIVE VIEW
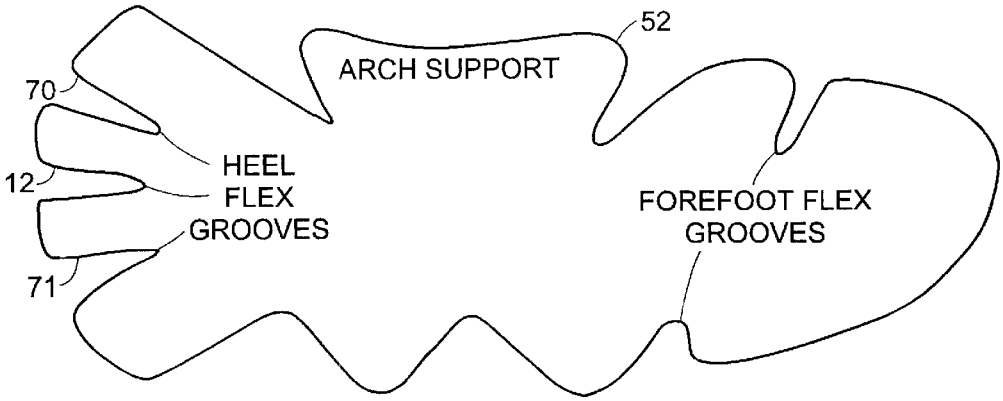
FIG. 8 FLAT PATTERN

SHOE HAVING AN EXTERNAL CHASSIS

CROSS-REFERENCE TO RELATED APPLICATIONS

This application is a continuation of U.S. Ser. No. 09/112,633, filed Jul. 9, 1998, now U.S. Pat. No. 6,119,373, which is a continuation-in-part of U.S. Ser. No. 08/697,184, filed Aug. 20, 1996, now U.S. Pat. No. 5,915,820. This application is also based on U.S. Provisional Patent application Ser. No. 60/052,053, filed Jul. 9, 1997. The disclosures of which are incorporated herein by reference in their entirety.

BACKGROUND OF THE INVENTION

This invention relates generally to shoes, and more particularly to shoes wherein light weight and the ability to tailor the stiffness and flexure of the shoe is an important consideration.

Shoes encounter tremendous forces during running or sports. Over the years, efforts have been made to reduce the resultant stresses on the feet and legs. One advance in this area has been the incorporation of cushioning material in the shoe sole to cushion the foot as the shoe strikes the ground. This cushioning material is typically formed into a layer called the "midsole" which is interposed between the ground-engaging "outsole" and the shoe upper. The cushioning midsole, which should also flex with the foot, is typically made of ethyl-vinyl-acetate (EVA) or polyurethane (PU), although other resilient, cushioning materials could be used.

While the cushioning provided by a midsole is an advantage, its added weight hinders the performance of athletic shoes (particularly running shoes), which must be as light as possible. The problem of added weight from the midsole is recognized in U.S. Pat. No. 5,319,866 issued to Foley et al. Foley et al. attempts to solve the problem by substituting an arch support in place of the midsole and outsole underlying the arch area of the foot.

The use of a midsole between the outsole and the upper also positions the foot higher above the ground, creating a less stable platform for the foot. This problem is addressed to some degree in U.S. Pat. No. 4,542,598 issued to Misevich et al. Misevich teaches use of a heel plate between two heel midsole layers to support and cushion the heel, and a forefoot board inside the upper over a forefoot midsole layer to support and cushion the forefoot. As in Foley, Misevich eliminates the midsole beneath the arch, thereby saving some weight. Unlike Foley, however, Misevich does not provide any additional structure to support the arch.

The negative effects of the impact to the feet and legs can be amplified if the shoes are not properly shaped and tuned to the particular sport, and to the individual's foot. Mass-produced athletic shoes come in standard sizes and shapes, and usually include an arch support designed to fit a "standard" foot. Prior art shoes, such as those typified by Foley and Misevich, include no provision for tailoring the shoe to fit an individual foot, except for the use of orthotics. Orthotics are well-known in the art, and are exemplified by U.S. Pat. No. 4,803,747 issued to Brown. Orthotics, however useful, represent additional, undesirable weight, and also stiffen the shoe and otherwise compromise its performance.

Accordingly, a need remains for a light-weight shoe that minimizes the material in the sole, adequately supports the foot, and which can be readily customized for an individual's foot or for a particular activity.

SUMMARY OF THE INVENTION

It is, therefore, an object of the invention to provide a shoe, in particular an athletic shoe, which can be customized to support the foot in accordance with requirements of a particular sport or activity.

It is another object of the invention to eliminate the need for an outsole and midsole which span substantially the entire length of the shoe.

A shoe according to the invention includes an upper, a chassis, or support member, attached to the underside of the upper to support the foot, and one or more ground-engaging sole elements affixed to the bottom of the chassis at discrete locations. Portions of the chassis are left exposed and unsupported by the sole elements. The weight of the shoe is thereby minimized because the full-length midsole and outsole have been replaced by the discrete sole elements.

The structural chassis may be contoured to conform to the underside of the foot. In one embodiment, the structural chassis has one or more notches or slots in locations selected to permit a desired flexure of the foot. The length and width of the notches can be varied to vary the shoe's flexibility. Alternatively, the structural chassis can be without flexure notches, and rely instead on differing thicknesses of materials to vary its flexibility in different areas of the shoe.

A shoe according to the present invention utilizes a single structure for altering the support and flex of the shoe, thereby overcoming the disadvantage in the prior art that requires multiple elements to be modified to achieve the same result.

The foregoing and other objects, features and advantages of the invention will become more readily apparent from the following detailed description of a preferred embodiment of the invention which proceeds with reference to the accompanying drawings.

BRIEF DESCRIPTION OF THE DRAWINGS

FIG. 6 is a lateral elevational view of an external chassis used in the shoe shown in FIG. 1.

FIG. 7 is a lateral perspective view of an external chassis used in the shoe shown in FIG. 1.

FIG. 8 is a top plan view of a chassis shown in FIGS. 2–4 before it has been formed into its final shape.

DETAILED DESCRIPTION

Figure 1:
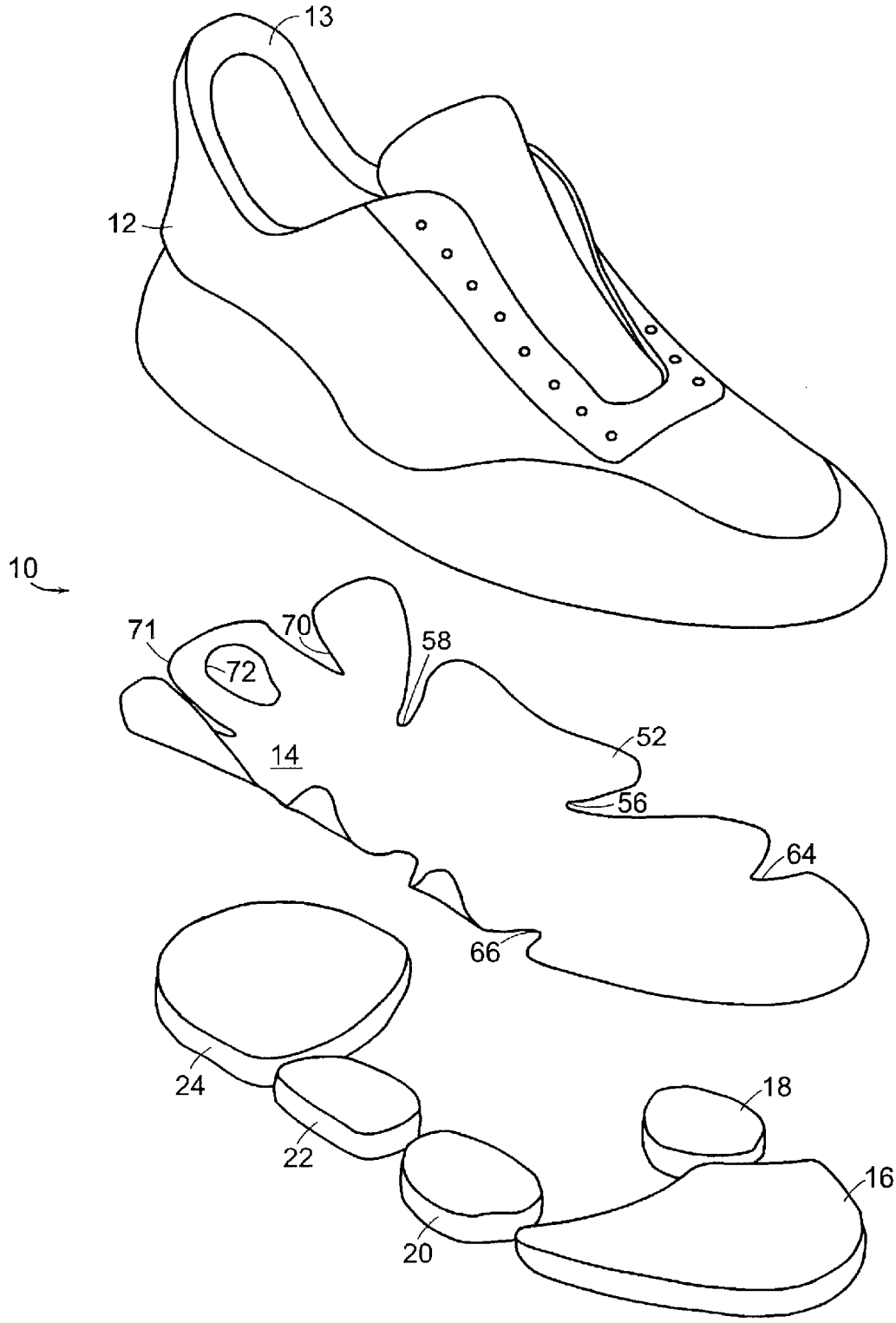
FIG. 1 is an exploded perspective view of a shoe according to the invention.
Figure 2:
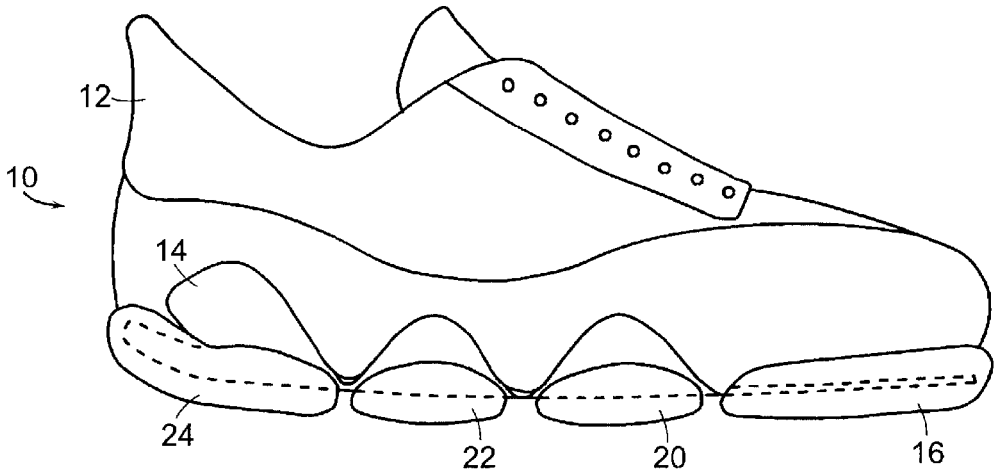
FIG. 2 is a right side elevational view of the shoe shown in FIG. 1.
Figure 3:
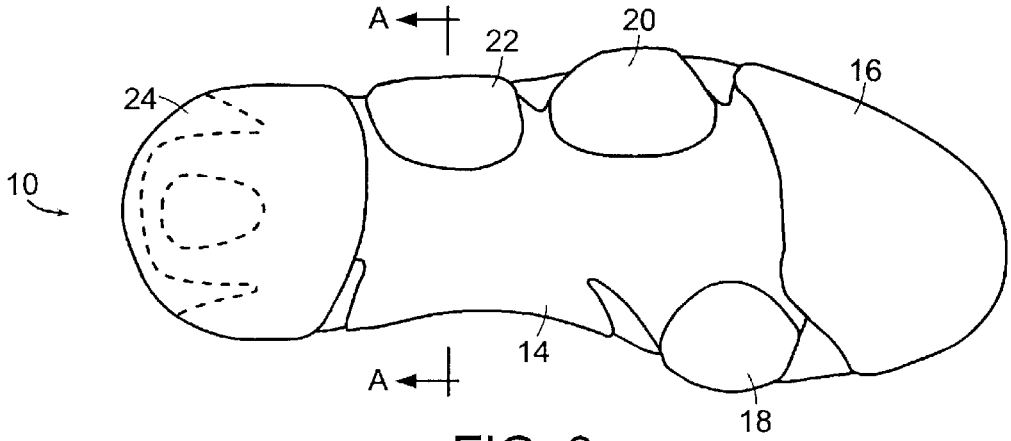
FIG. 3 is a bottom plan view of the shoe shown in FIG. 1.

A right shoe 10 according to the invention is shown in FIGS. 1–3. A corresponding left shoe is a mirror image of the right shoe and is therefore not described further. The shoe includes an upper 12 that is designed to receive a foot. The upper 12 can be made of any number of materials as is known in the art including mesh and/or leather, and is preferably of a moccasin-type construction. An advantage of the present invention is that since structural support for the foot is provided by the external chassis described below, the upper need not do so, and its weight can be minimized. In the embodiment shown in FIGS. 1 and 3, a conventional lacing system incorporating holes in the upper is used, although other lacing arrangements could be used. The upper further may also include features such as a foam-filled ankle collar 13 surrounding the ankle opening for added comfort. The description of the upper 12 is by way of illustration only; numerous alternative upper designs will work equally well.

Mounted on the bottom of upper 12 is an external chassis 14, which underlies and supports the foot. Sole elements 16, 18, 20, 22, and 24 underlie chassis 14, and in the preferred embodiment, are attached thereto by an adhesive.

Figure 5:
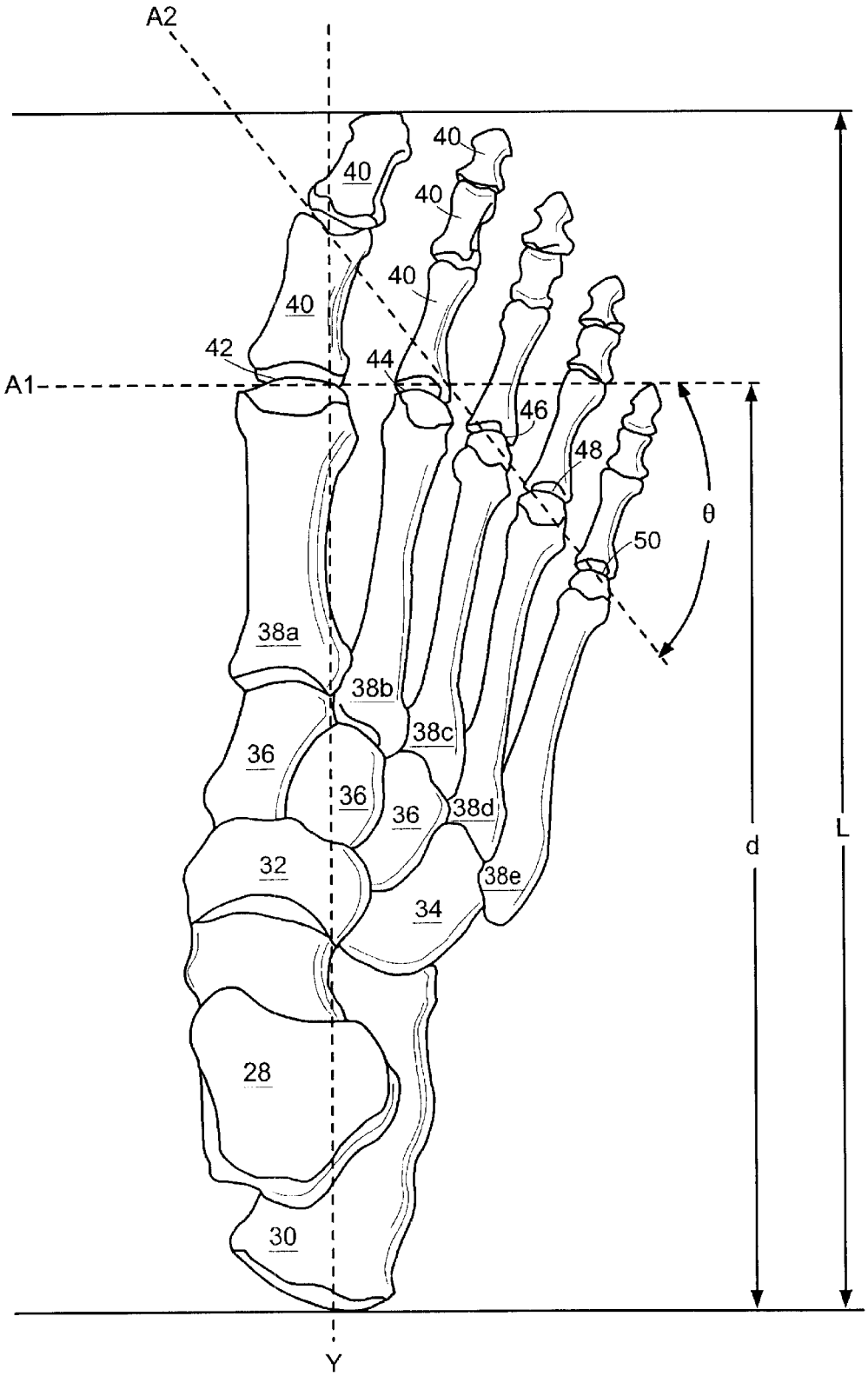
FIG. 5 is a top plan skeletal view of a human foot.

The design of chassis 14 is based on the structure and bio-mechanics of the human foot. A top plan view of a right human foot skeleton is shown in FIG. 5. The foot is attached to the leg (not shown) by the talus or anklebone 28. Positioned below and rearwardly of the talus 28 is the calcaneus 30 (i.e., the heel bone). The navicular 32 and the cuboid 34 are positioned below and forward of the talus 28. Three cuneiform bones 36 extend forwardly from the navicular 32. Extending forwardly from the cuneiform bones 36 and from the cuboid 34 are the five metatarsals 38, which are numbered a through e from left to right in FIG. 5 (i.e., from big toe to little toe). Forwardly of each metatarsal bone is a respective phalange 40 that forms the toe.

Between each metatarsal and its respective phalange is a metatarsal phalangeal (MTP) joint. Thus, there are five MTP joints in all: a first MTP joint 42, a second MTP joint 44, a third MTP joint 46, a fourth MTP joint 48, and a fifth MTP joint 50. These MTP joints can be used to define two axes about which the foot pushes off during, certain push-off movements. A lateral push-off axis $A_2$ is defined by a line running generally through the third (46), fourth (48), and fifth (50) MTP joints. The lateral push-off axis is used for push-offs towards the lateral side. Turning now to FIG. 2, chassis 14 is designed to accommodate the natural flexing of the foot about the lateral push-off axes.

In the preferred embodiment, chassis 14 is shaped to underlie and support the entire foot. In an alternative embodiment, the chassis underlies the arch and the forward portion of the foot, a heel-supporting sole element is attached directly to the upper. The chassis is preferably made of a relatively stiff, resilient material, such as plastic, fiberglass, or a carbon fiber-containing material for high-performance applications. The embodiment shown in FIGS. 1–3 includes an arch support flange 52, the size and shape of which can be varied as required for different foot types and for different sports. Notches 56 and 58 at the base of arch support flange 52 provide a predetermined amount of torsional flexure in the middle part of the chassis and shoe. The length and/or width of notches 56 and 58 can be varied as well to provide nearly any amount of torsional rigidity to the shoe. Notches 64 and 66 formed on opposite sides of the chassis along axis $A_2$, which underlies the lateral push-off axis $A_2$ of the foot. The length and/or width of these two notches can also be varied to produce the desired stiffness and/or flexibility of the shoe about the lateral axis.

In the embodiment shown in FIG. 1 slots 70, 71 and hole 72 are formed in the heel portion of the chassis to provide flexibility in this region. Additional slots can be formed within the heel region if desired, and as with the other notches described above, the length and/or width can be modified. Chassis 14 also includes medial and lateral heel flanges 80 and 82 respectively to center and retain the heel in place.

The embodiment shown in FIGS. 1–3 includes sole elements 16, 18, 20, 22 and 24 attached to the bottom surface of chassis 14. As will be appreciated by persons skilled in the art however, more or fewer sole elements of different configurations may be used. Sole elements may be positioned to correspond to one or more ground-engaging anatomical structures of the unshod foot. Referring to FIG. 5, these points include, but are not limited to, the calcaneus, the head of the first metatarsal, the head of the fifth metatarsal, the base of the fifth metatarsal, the head of the first distal phalange, and the head of the fifth distal phalange.

Each sole element provides traction, abrasion resistance and cushioning. These functions can be satisfied in many different ways. Any of sole elements 16, 18, 20, 22 and 24 can have an outer, abrasion-resistant layer 19 made from a material such as a durable rubber. The outer layer 19 encases a cushioning material 96 such as EVA or polyurethane. Other embodiments of the sole elements are described further below. In the preferred embodiment, each sole element is affixed to the bottom of the chassis using conventional adhesives, although the invention is not limited thereto. Sole element 24 is affixed to the heel portion where it provides traction, and cushions impacts to the calcaneus or heel bone of the foot. Element 18 is affixed to the chassis in the region underlying the "ball of the foot", and provides traction and cushioning for the first metatarsal head. Sole elements 20 and 22 support the fifth metatarsal head, and the base of the fifth metatarsal in the lateral midtarsal portion of the foot respectively. Sole element 16 is affixed to the chassis below the toe region of the upper, and in other embodiments can extend forward and upwardly around the front end of upper. Any number of different surface ornamentations can be applied to these portions, limited only by the creativity and ingenuity of the shoe designer.

Figure 4:
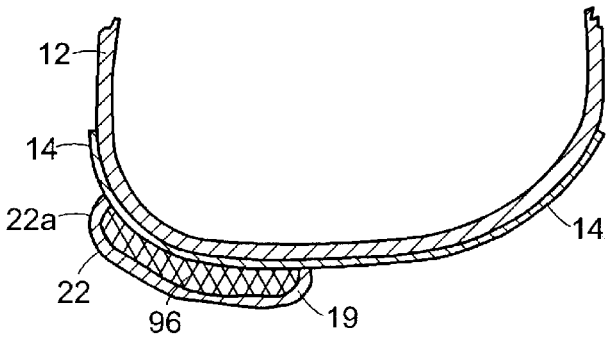
FIG. 4 is a cross-sectional view of the shoe of FIG. 1 with the chassis of FIGS. 2–4 taken along lines A—A in FIG. 3.

Any of the sole elements 16, 18, 20, 22 and 24 in the preferred embodiment include rounded edges as shown at 22*a* in FIG. 4. This feature is explained in greater detail in U.S. Pat. No. 5,317,819 to Ellis, which is hereby incorporated by reference.

Figure 9:
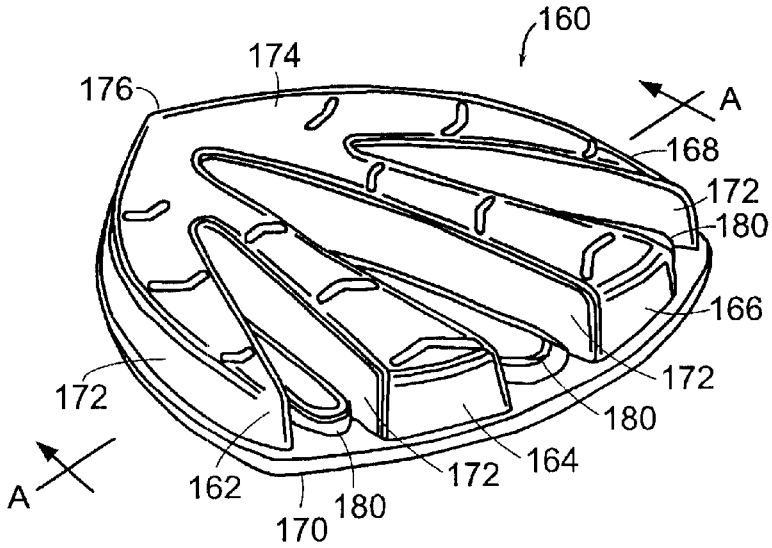
FIG. 9 is a perspective view of an alternative design for a sole element.
Figure 10:
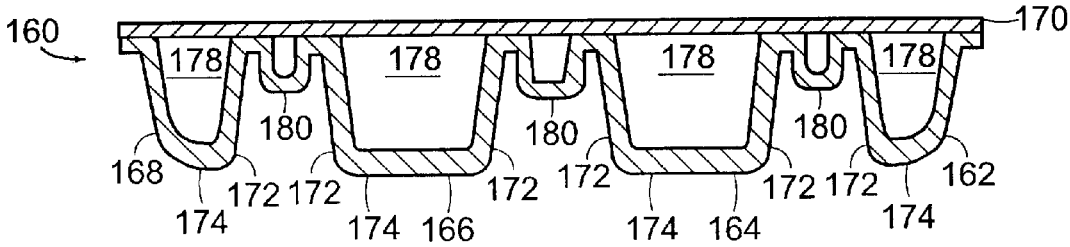
FIG. 10 is a cross-sectional view of the sole element shown in FIG. 9 along line A—A.

In another embodiment, the sole elements are filled with gas, such as air, or a visco-elastic material. A yet further embodiment of the sole elements is shown in FIGS. 9 and 10. In those figures an individual sole element 160 is shown, which is preferably mounted on the shoe underneath the calcaneus bone, i.e., the heel. As in the embodiment described earlier, other similar sole elements can be placed in other load bearing points on the shoe corresponding to one or more ground-engaging anatomical structures of the unshod foot, including, but not limited to the calcaneus, the head of the first metatarsal, the head of the fifth metatarsal, the base of the fifth metatarsal, the head of the first distal phalange, and the head of the fifth distal phalange.

Sole element 160 includes a plurality of air or visco-elastic filled deformation elements 162, 164, 166 and 168. These deformation elements are mounted on a base layer 170. The deformation elements are preferably elongate, channels extending generally, radially outward from a common origin 176. The channels are formed by sidewalls 172 extending vertically upward from the base layer to a top, ground-contacting surface 174 and sealed by end-walls to form sealed interior channels 178. These channels 178 are then filled with a gas, such as air, or a visco-elastic material. A plurality of hollow, intermediate ribs 180 can be mounted on the base plate between adjacent deformation elements. The deformation elements allow the base plate to shift horizontally relative to the ground-contacting surface as a result of impact. This shifting reduces the impact by increasing the amount of time the load is dissipated over. Other embodiments of these deformation elements are described in commonly-assigned, copending patent application Ser. No. 08/327,461 filed Aug. 16, 1995 entitled "Anisotropic Deformation pad for Footwear," incorporated herein by reference. The shoe according to the invention can work with any of the embodiments shown therein.

Figure 11:
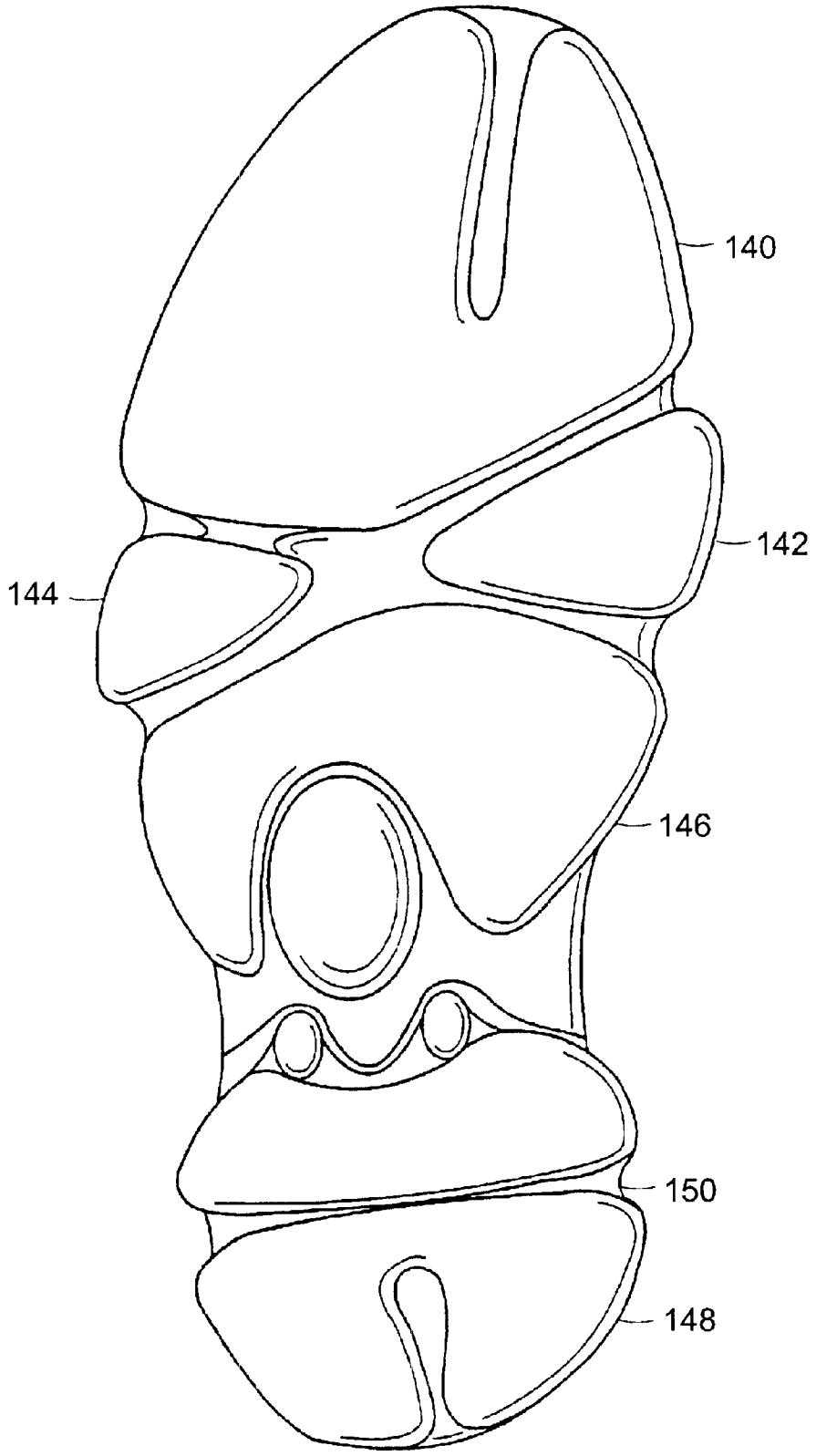
FIG. 11 is a bottom plan view of a second embodiment of a shoe according to the invention.

Having described and illustrated the principles of the invention in a preferred embodiment thereof, it should be apparent that the invention can be modified in arrangement and detail without departing from such principles. For example, the design of the sole elements can be modified so that different portions of the upper are exposed than those shown above. An example of such an alternative design is shown in FIG. 11. In that design the sole elements include a toe element 140, a forefoot element 146, and a heel element 148. Two additional forefoot elements 142 and 144 are disposed between the toe portion and the forefoot portion. The lateral element 144 is integrally formed with the main forefoot portion 146 while the medial forefoot element 142 is a separately formed element. These elements are arranged so as to create a flex-groove therebetween as described further above. The heel portion 148 also includes a heel flex groove 150. Unlike the forefoot flex groove, however, the heel flex groove 150 does not necessarily expose the upper. Instead the sole element is grooved in this area so as to provide a desired amount of stiffness and/or flexibility in heel area.

We claim all modifications and variation coming within the spirit and scope of the following claims.

We claim:

1. A shoe comprising:

an upper including a bottom surface;

a structural chassis affixed to an exterior of the bottom surface of the upper, the chassis comprising at least one upwardly extending flange; and a plurality of spaced-apart sole elements affixed to a bottom surface of the structural chassis, wherein at least one of the plurality of sole elements extends upwardly along the chassis flange and the structural chassis bottom surface includes at least one exposed, unsupported portion between the sole elements.

2. A shoe according to claim 1, wherein the bottom surface of the upper is flexible and non-supportive.

3. A shoe according to claim 1, wherein at least one of the plurality of sole elements is affixed to the bottom surface of the chassis at a location selected to underlie a portion of a wearer's foot selected from the group consisting of a calcaneus, a head of a first metatarsal, a head of a fifth metatarsal, a base of the fifth metatarsal, a head of a first distal phalange, and a head of a fifth distal phalange.

4. A shoe according to claim 1, wherein the exposed unsupported portion of the bottom surface of the chassis is positioned to underlie a portion of a wearer's arch.

5. A shoe according to claim 1, wherein the exposed unsupported portion of the bottom surface of the chassis is positioned to underlie a push-off axis defined by a line passing generally through first and second metatarsal-phalangeal joints of a wearer's foot.

6. A shoe according to claim 1 wherein the exposed unsupported portion of the bottom surface of the chassis is positioned to underlie a push-off axis defined by a line passing generally through third, fourth, and fifth metatarsal-phalangeal joints of a wearer's foot.

7. A shoe according to claim 1, wherein the chassis includes:

a rear portion;

a middle portion; and a front portion.

8. A shoe according to claim 7, wherein the front portion includes a forefront supporting portion, a toe supporting portion, and a flexure axis therebetween.

9. A shoe according to claim 8, wherein the flexure axis between the forefoot and toe supporting portions is aligned with opposed lateral notches formed in the chassis.

10. A shoe according to claim 7, wherein the middle portion includes at least one upwardly extending lateral flange.

11. A shoe according to claim 10, wherein the at least one upwardly extending lateral flange includes a flange corresponding to a head of a fifth metatarsal of a wearer's foot.

12. A shoe according to claim 10, wherein the at least one upwardly extending lateral flange includes a flange corresponding to a base of a fifth metatarsal of a wearer's foot.

13. A shoe according to claim 7, wherein the middle portion includes at least one upwardly extending medial flange.

14. A shoe according to claim 13, wherein the medial flange corresponds to an arch of a wearer's foot.

15. A shoe according to claim 7, wherein the rear portion includes at least one heel-supporting flange.

16. A shoe according to claim 15, wherein the at least one heel-supporting flange includes an upwardly extending, lateral heel-supporting flange.

17. A shoe according to claim 7, wherein the rear portion includes surfaces defining at least one groove in the heel portion.

18. A shoe according to claim 17, wherein the surfaces defining at least one groove in the heel portion define a generally longitudinal groove.

19. A shoe according to claim 17, wherein the surfaces defining at least one groove in the heel portion define at least one generally oblique groove.

20. A shoe according to claim 17, wherein the surfaces defining at least one groove in the heel portion define a generally longitudinal groove and at least one general oblique groove.

21. A shoe according to claim 17, wherein the surfaces defining at least one groove in the heel portion comprise at least one heel-supporting flange.

22. A shoe according to claim 1 in which the upper is of a moccasin-type construction.

23. A shoe according to claim 1 which further comprises an insole within the upper.

24. A shoe according to claim 1, wherein the structural chassis comprises a stiff, resilient material.

25. A shoe according to claim 1 characterized by absence of a midsole.

* * * * *